US011890716B2

(12) United States Patent
Yazawa et al.

(10) Patent No.: US 11,890,716 B2
(45) Date of Patent: Feb. 6, 2024

(54) POLISHING UNIT, SUBSTRATE PROCESSING APPARATUS, AND POLISHING METHOD

(71) Applicant: EBARA CORPORATION, Tokyo (JP)

(72) Inventors: Akihiro Yazawa, Tokyo (JP); Kenichi Kobayashi, Tokyo (JP); Asagi Matsugu, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 332 days.

(21) Appl. No.: 17/117,723

(22) Filed: Dec. 10, 2020

(65) Prior Publication Data

US 2021/0187692 A1 Jun. 24, 2021

(30) Foreign Application Priority Data

Dec. 24, 2019 (JP) ..... 2019-233037

(51) Int. Cl.
*B24B 37/005* (2012.01)
*B24B 37/04* (2012.01)
*B24B 49/12* (2006.01)

(52) U.S. Cl.
CPC ..... *B24B 37/0053* (2013.01); *B24B 37/04* (2013.01); *B24B 49/12* (2013.01)

(58) Field of Classification Search
CPC ... B24B 37/0053; B24B 37/04; B24B 37/005; B24B 37/102; B24B 37/32; B24B 37/34;
(Continued)

(56) References Cited

U.S. PATENT DOCUMENTS 5,823,853 A * 10/1998 Bartels ..... B24B 49/04 451/6
6,293,846 B1 * 9/2001 Oguri ..... B24B 55/00 451/6
(Continued)

FOREIGN PATENT DOCUMENTS

JP H11-10525 A 1/1999
JP H11-345791 A 12/1999
(Continued)

OTHER PUBLICATIONS

Extended European Search Report dated May 27, 2021 issued in European Patent Application No. EP 2021 2570.4.

*Primary Examiner* — Joel D Crandall
*Assistant Examiner* — Michael A Gump
(74) *Attorney, Agent, or Firm* — PEARNE & GORDON LLP

(57) ABSTRACT

An accuracy of detecting a slip out of a substrate from a top ring is improved. A polishing unit 300 includes a polishing table 350, a top ring 302, a light emitting member 371, a slip-out detector 370, and an elimination mechanism 380. A polishing pad 352 that polishes a substrate WF is attached to the polishing table 350. The top ring 302 holds the substrate WF to press the substrate WF against the polishing pad 352. The light emitting member 371 emits a light to a detection area 372 on the polishing pad 352. The slip-out detector 370 detects a slip out of the substrate WF from the top ring 302 based on the light reflected from the detection area 372. The elimination mechanism 380 eliminates a polishing liquid flowing into the detection area 372.

8 Claims, 12 Drawing Sheets

(58) Field of Classification Search
CPC ..... B24B 37/345; B24B 37/042; B24B 37/30; B24B 49/12; B24B 49/04; B24B 55/00; B24B 55/12; B24B 7/228; H01L 21/67092
USPC ..... 451/1
See application file for complete search history.

(56) References Cited

U.S. PATENT DOCUMENTS

| | | | | |
|---|---|---|---|---|
| 6,425,801 | B1 | 7/2002 | Takeishi et al. | |
| 6,461,222 | B1 * | 10/2002 | Sato | B24B 49/12 451/6 |
| 2005/0130562 | A1 * | 6/2005 | Nabeya | B24B 49/12 451/6 |
| 2005/0221724 | A1 | 10/2005 | Terada et al. | |
| 2009/0036024 | A1 * | 2/2009 | Matsuzaki | B24B 49/105 451/287 |
| 2009/0209175 | A1 * | 8/2009 | Saito | B24B 49/12 451/6 |
| 2015/0117755 | A1 * | 4/2015 | Doughty | G06T 7/001 382/151 |
| 2015/0231760 | A1 * | 8/2015 | Maruyama | B24B 49/14 451/7 |
| 2017/0304986 | A1 | 10/2017 | Ueno et al. | |
| 2018/0297170 | A1 * | 10/2018 | Chen | B24B 53/017 |
| 2021/0031331 | A1 * | 2/2021 | Trojan | H01L 22/20 |

FOREIGN PATENT DOCUMENTS

| | | | |
|---|---|---|---|
| JP | 3761673 | B2 | 3/2006 |
| JP | 2006-128582 | A | 5/2006 |
| JP | 2016-087713 | A | 5/2016 |
| WO | 2006-009304 | A1 | 1/2006 |
| WO | 2006-049269 | A1 | 5/2006 |

* cited by examiner

POLISHING UNIT, SUBSTRATE PROCESSING APPARATUS, AND POLISHING METHOD

TECHNICAL FIELD

This application relates to a polishing unit, a substrate processing apparatus, and a polishing method. This application claims priority from Japanese Patent Application No. 2019-233037 filed on Dec. 24, 2019. The entire disclosure including the descriptions, the claims, the drawings, and the abstracts in Japanese Patent Application No. 2019-233037 is herein incorporated by reference.

BACKGROUND ART

In manufacturing a semiconductor device, a chemical mechanical polishing (CMP) apparatus is used for planarization of a surface of a substrate. The substrate used in the manufacture of the semiconductor device often has a circular plate shape. Not limited to the semiconductor device, a demand for flatness in planarization of a surface of a rectangular substrate, such as a CCL substrate (Copper Clad Laminate substrate), a PCB (Printed Circuit Board) substrate, a photomask substrate, and a display panel, has increased. A demand for planarizing a surface of a package substrate on which electronic devices, such as a PCB substrate, are disposed also has increased.

A chemical mechanical polishing device includes a top ring that holds a substrate and a polishing table to which a polishing pad is attached, and is configured to polish the substrate by pressing the substrate against the polishing pad while rotating the top ring and the polishing table. Here, in the polishing of the substrate, the substrate comes off from the top ring to slip outside the top ring in some cases. In contrast, for example, PTL 1 discloses that a photoelectric sensor is used to detect the slip out of the substrate.

CITATION LIST

Patent Literature

PTL 1: Japanese Patent No. 3761673

SUMMARY OF INVENTION

Technical Problem

In the technique disclosed in PTL 1, a light is emitted toward a detection area set on a polishing pad to detect the slip out of the substrate based on a change of an amount of the light reflected from the detection area. That is, since the polishing pad and the substrate are different in light reflectance, the amount of the reflected light from the detection area changes when the substrate comes off from the top ring to appear in the detection area, thereby determining that the substrate has come off from the top ring when the change is detected. PTL 1 also discloses the detection of the slip out of the substrate using a color difference sensor.

However, the technique disclosed in PTL 1 still has a room to improve the accuracy of detecting the slip out of the substrate. That is, since the substrate as a process target of the polishing device has a variety in thickness and base material (material) and is large in variation of the reflection-light amount, the photoelectric sensor possibly makes a false detection in the detection method using the light-amount difference. While the polishing device uses a slurry (polishing liquid) to polish the substrate, shavings are generated from the substrate to be mixed in the slurry during the polishing, or the slurry is discolored by a chemical reaction or the like in some cases. This possibly causes the sensor to make a false detection due to flowing of the slurry in which the shavings are mixed or the discolored slurry into the detection area even when the color difference sensor is used.

Therefore, this application has one object to improve an accuracy of detecting a slip out of a substrate from a top ring.

Solution to Problem

One embodiment discloses a polishing unit that includes a polishing table, a top ring, a light emitting member, a slip-out detector, and an elimination mechanism. A polishing pad for polishing a substrate is attached to the polishing table. The top ring holds the substrate to press the substrate against the polishing pad. The light emitting member emits a light to a detection area on the polishing pad. The slip-out detector detects a slip out of the substrate from the top ring based on the light reflected from the detection area. The elimination mechanism eliminates a polishing liquid flowing into the detection area.

DESCRIPTION OF EMBODIMENTS

Figure 1:
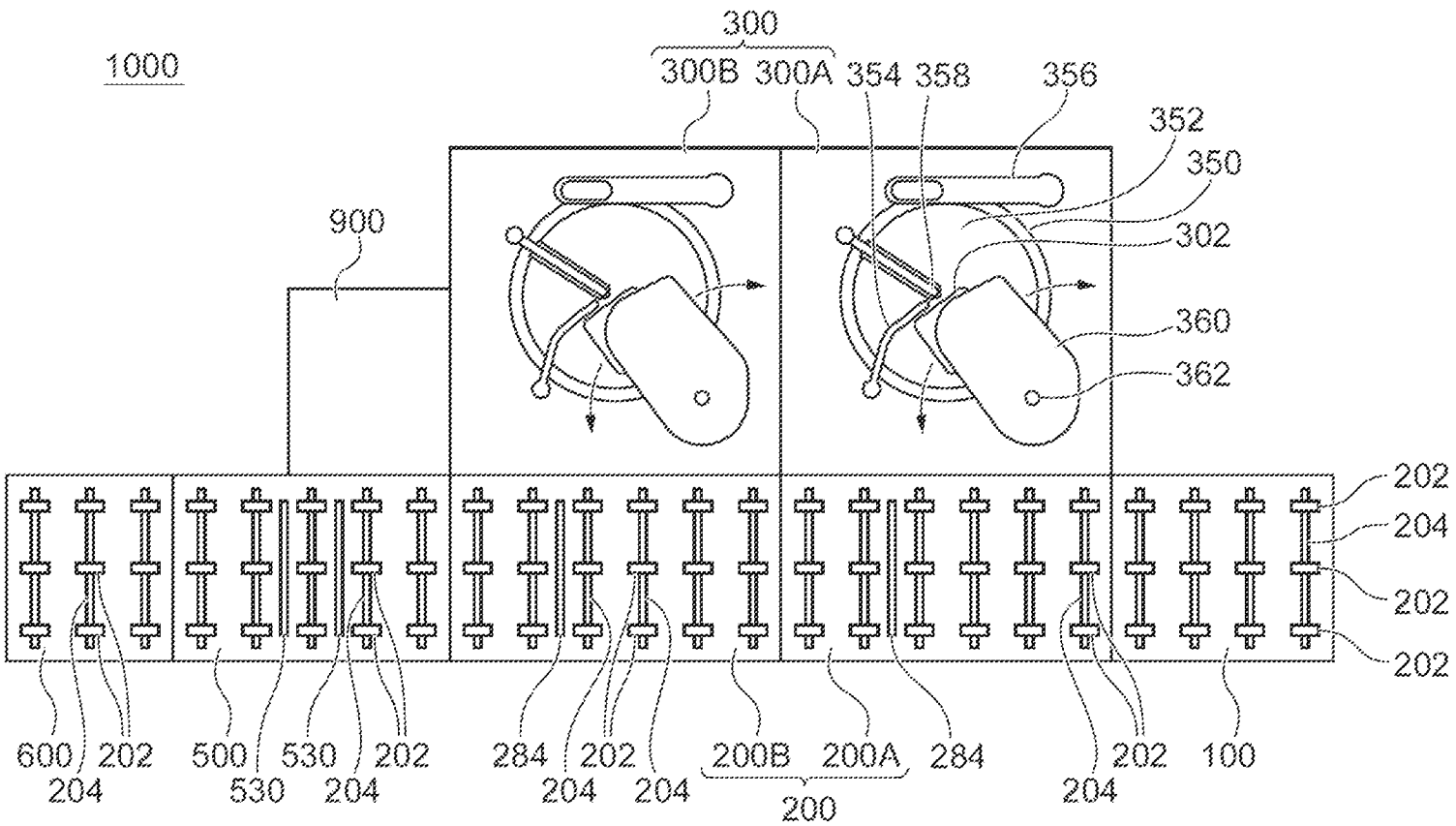
FIG. 1 is a plan view illustrating an overall configuration of a substrate processing apparatus according to one embodiment.

The following describes embodiments of a substrate processing apparatus according to the present invention with reference to the attached drawings. In the attached drawings, the same or similar reference numerals are attached to the same or similar components, and overlapping description regarding the same or similar components may be omitted in the description of the respective embodiments. Features illustrated in the respective embodiments are applicable to other embodiments in so far as they are consistent with one another.

FIG. 1 is a plan view illustrating an overall configuration of a substrate processing apparatus 1000 according to one embodiment. The substrate processing apparatus 1000 illustrated in FIG. 1 includes a loading unit 100, a conveyance unit 200, a polishing unit 300, a drying unit 500, and an unloading unit 600. In the illustrated embodiment, the conveyance unit 200 includes two conveyance units 200A, 200B, and the polishing unit 300 includes two polishing units 300A, 300B. In the one embodiment, these units can be each independently formed. Independently forming these units ensures facilitating to form the substrate processing apparatus 1000 in a different configuration by appropriately combining the number of respective units. The substrate processing apparatus 1000 includes a control device 900, and each component of the substrate processing apparatus 1000 is controlled by the control device 900. In the one embodiment, the control device 900 can be configured of a general computer that includes, for example, an input/output device, an arithmetic device, and a storage device.

<Loading Unit>

The loading unit 100 is a unit for introducing a substrate WF before processes, such as polishing and cleaning, are performed into the substrate processing apparatus 1000. In the one embodiment, the loading unit 100 is configured to be compliant to a mechanical equipment interface standard (IPC-SMEMA-9851) of Surface Mount Equipment Manufacturers Association (SMEMA).

In the illustrated embodiment, a conveyance mechanism of the loading unit 100 includes a plurality of conveyance rollers 202 and a plurality of roller shafts 204 to which the conveyance rollers 202 are mounted. In the embodiment illustrated in FIG. 1, the three conveyance rollers 202 are mounted to each roller shaft 204. The substrate WF is disposed on the conveyance roller 202, and the substrate WF is conveyed by rotation of the conveyance roller 202. The conveyance rollers 202 may be mounted to the roller shaft 204 at any positions insofar as they are positions that ensure stable conveyance of the substrate WF. However, since the conveyance rollers 202 contact the substrate WF, the conveyance rollers 202 need to be disposed so as to contact a region without a problem even when the conveyance rollers 202 contact the substrate WF as a process target. In the one embodiment, the conveyance roller 202 of the loading unit 100 can be formed of a conductive polymer. In the one embodiment, the conveyance rollers 202 are electrically earthed via the roller shafts 204 or the like. This is performed to avoid a damage of an electronic device and the like on the substrate WF due to charging of the substrate WF. In the one embodiment, the loading unit 100 may include an ionizer (not illustrated) to avoid the charging of the substrate WF.

<Conveyance Unit>

The substrate processing apparatus 1000 illustrated in FIG. 1 includes the two conveyance units 200A, 200B. Since the two conveyance units 200A, 200B can have the same configuration, they are collectively described as the conveyance unit 200 in the following description.

The illustrated conveyance unit 200 includes a plurality of conveyance rollers 202 to convey the substrate WF. By rotating the conveyance rollers 202, the substrate WF on the conveyance rollers 202 can be conveyed in a predetermined direction. The conveyance rollers 202 of the conveyance unit 200 may be formed of a conductive polymer, or formed of a non-conductive polymer. The conveyance rollers 202 are driven by a motor (not illustrated). The substrate WF is conveyed to a substrate transfer position by the conveyance rollers 202.

In the one embodiment, the conveyance unit 200 includes a cleaning nozzle 284. The cleaning nozzle 284 is connected to a supply source (not illustrated) of a cleaning liquid. The cleaning nozzle 284 is configured to supply the cleaning liquid to the substrate WF conveyed by the conveyance rollers 202.

<Drying Unit>

The drying unit 500 is a device to dry the substrate WF. In the substrate processing apparatus 1000 illustrated in FIG. 1, the drying unit 500 dries the substrate WF cleaned by a cleaning unit of the conveyance unit 200 after the polishing by the polishing unit 300. As illustrated in FIG. 1, the drying unit 500 is disposed in the downstream of the conveyance unit 200.

The drying unit 500 includes a nozzle 530 to inject a gas toward the substrate WF conveyed on the conveyance rollers 202. The gas may be, for example, a compressed air or nitrogen. By blowing off water droplets on the conveyed substrate WF by the drying unit 500, the substrate WF can be dried.

<Unloading Unit>

The unloading unit 600 is a unit to carry out the substrate WF after the processes, such as the polishing and the cleaning, are performed outside the substrate processing apparatus 1000. In the substrate processing apparatus 1000 illustrated in FIG. 1, the unloading unit 600 receives the substrate after the drying by the drying unit 500. As illustrated in FIG. 1, the unloading unit 600 is disposed in the downstream of the drying unit 500. In the one embodiment, the unloading unit 600 is configured to be compliant to the mechanical equipment interface standard (IPC-SMEMA-9851) of Surface Mount Equipment Manufacturers Association (SMEMA).

<Polishing Unit>

Figure 2:
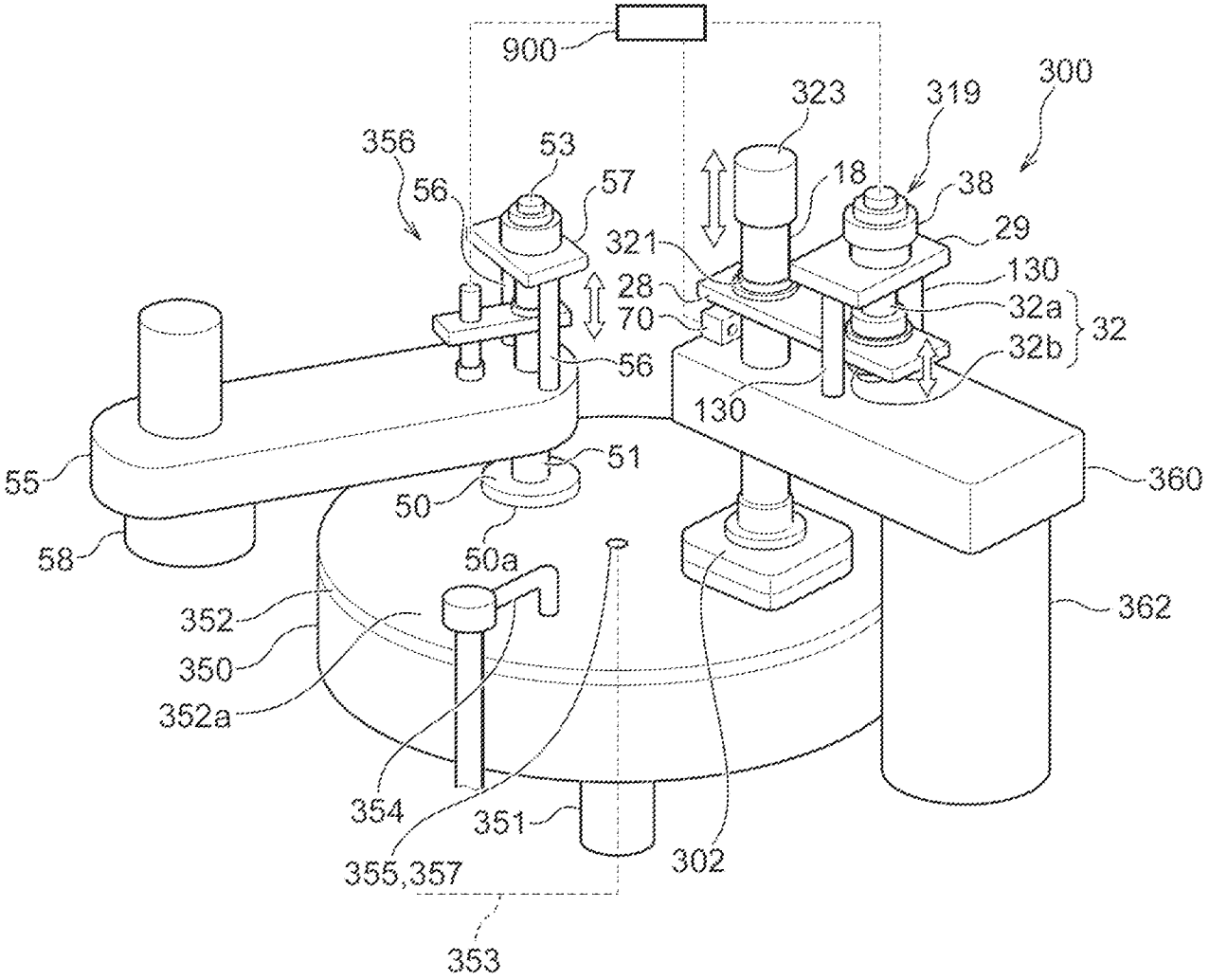
FIG. 2 is a perspective view schematically illustrating a configuration of a polishing unit according to the one embodiment.

FIG. 2 is a perspective view schematically illustrating a configuration of the polishing unit 300 according to the one embodiment. The substrate processing apparatus 1000 illustrated in FIG. 1 includes the two polishing units 300A, 300B. Since the two polishing units 300A, 300B can have the same configuration, they are collectively described as the polishing unit 300 in the following description.

As illustrated in FIG. 2, the polishing unit 300 includes a polishing table 350 and a top ring 302. The top ring 302 constitutes a polishing head that holds the substrate as an object to be polished to press to a polishing surface on the polishing table 350. The polishing table 350 is connected to a polishing table rotation motor (not illustrated) disposed via the table shaft 351 therebelow, and rotatable about the table shaft 351. A polishing pad 352 is attached to a top surface of the polishing table 350, and a surface 352*a* of the polishing pad 352 constitutes the polishing surface to polish the substrate. In the one embodiment, the polishing pad 352 may be attached via a layer to facilitate detaching from the polishing table 350. Such a layer includes a silicone layer, a fluorine-based resin layer, and the like, and for example, a layer disclosed in Japanese Unexamined Patent Application Publication No. 2014-176950 may be used.

A polishing liquid supply nozzle 354 is disposed above the polishing table 350, and the polishing liquid supply nozzle 354 is configured to supply the polishing liquid on the polishing pad 352 on the polishing table 350. As illustrated in FIG. 2, a passage 353 is disposed through the polishing table 350 and the table shaft 351 to supply the polishing liquid. The passage 353 is communicated with an opening portion 355 in the surface of the polishing table 350. The polishing pad 352 is provided with a through-hole 357 at a position corresponding to the opening portion 355 of the polishing table 350, and the polishing liquid passing through the passage 353 is supplied to the surface of the polishing pad 352 from the opening portion 355 of the polishing table 350 and the through-hole 357 of the polishing pad 352. The numbers of the opening portions 355 of the polishing table 350 and the through-holes 357 of the polishing pad 352 may be one or more. While the positions of the opening portion 355 of the polishing table 350 and the through-hole 357 of the polishing pad 352 may be any positions, they are provided in the proximity of the center of the polishing table 350 in the one embodiment.

While not illustrated in FIG. 2, in the one embodiment, the polishing unit 300 includes an atomizer 358 (see FIG. 1) to inject a liquid or a mixture fluid of liquid and gas toward the polishing pad 352. The liquid injected from the atomizer 358 is, for example, pure water, and the gas is, for example, nitrogen gas.

The top ring 302 is connected to a top ring shaft 18, and the top ring shaft 18 is configured to be moved up and down with respect to a swing arm 360 by an up-and-down motion mechanism 319. The top ring 302 is configured to be entirely moved up and down with respect to the swing arm 360 by the up-and-down motion of the top ring shaft 18 and positioned. The top ring shaft 18 is configured to be rotated by the driving of a top ring rotation motor (not illustrated). The top ring 302 is configured to be rotated about the top ring shaft 18 by the rotation of the top ring shaft 18. A rotary joint 323 is mounted to an upper end of the top ring shaft 18.

Various kinds of the polishing pad are available in the market, and for example, SUBA800 ("SUBA" is registered trademark), IC-1000, and IC-1000/SUBA400 (two-layer cloth) manufactured by Nitta Haas Incorporated, and Surfin xxx-5, Surfin 000, and the like ("Surfin" is registered trademark) manufactured by FUJIMI INCORPORATED are included. SUBA800, Surfin xxx-5, and Surfin 000 are non-woven fabrics made of fibers hardened with urethane resin, and IC-1000 is a rigid polyurethane foam (single layer). The polyurethane foam is porous, and many fine hollows or holes are provided in its surface.

The top ring 302 is configured to hold the rectangular substrate in its lower surface. The swing arm 360 is configured to be turnable about a spindle 362. The top ring 302 is movable between the substrate transfer position of the conveyance unit 200 described above and a position above the polishing table 350 by the turn of the swing arm 360. By moving down the top ring shaft 18, the top ring 302 can be moved down to press the substrate to the surface (polishing surface) 352*a* of the polishing pad 352. At this time, the top ring 302 and the polishing table 350 are each rotated, and the polishing liquid is supplied on the polishing pad 352 from the polishing liquid supply nozzle 354 disposed above the polishing table 350 and/or from the opening portion 355 provided to the polishing table 350. Thus, the substrate WF is pressed to the polishing surface 352*a* of the polishing pad 352, thereby allowing the polishing of the surface of the substrate. The swing arm 360 may be fixed or swung such that the top ring 302 passes through the center of the polishing pad 352 (covers the through-hole 357 of the polishing pad 352) during the polishing of the substrate WF.

The up-and-down motion mechanism 319 that moves the top ring shaft 18 and the top ring 302 up and down includes a bridge 28, a ball screw 32, a support table 29, and a servo motor 38. The bridge 28 rotatably supports the top ring shaft 18 via a bearing 321. The ball screw 32 is mounted to the bridge 28. The support table 29 is supported by a support pillar 130. The servo motor 38 is disposed on the support table 29. The support table 29 that supports the servo motor 38 is secured to the swing arm 360 via the support pillar 130.

The ball screw 32 includes a screw shaft 32*a* connected to the servo motor 38, and a nut 32*b* with which the screw shaft 32*a* screws. The top ring shaft 18 is configured to move up and down integrally with the bridge 28. Accordingly, when the servo motor 38 is driven, the bridge 28 moves up and down via the ball screw 32, thereby moving the top ring shaft 18 and the top ring 302 up and down. The polishing unit 300 includes a distance measuring sensor 70 as a position detection unit that detects a distance to a lower surface of the bridge 28, that is, a position of the bridge 28. By detecting the position of the bridge 28 by the distance measuring sensor 70, the position of the top ring 302 can be detected. The distance measuring sensor 70 constitutes the up-and-down motion mechanism 319 together with the ball screw 32 and the servo motor 38. The distance measuring sensor 70 may be a laser sensor, an ultrasonic wave sensor, an overcurrent sensor, or a linear scale sensor. The devices in the polishing unit including the distance measuring sensor 70 and the servo motor 38 are each configured to be controlled by the control device 900.

The polishing unit 300 according to the one embodiment includes a dressing unit 356 that dresses the polishing surface 352*a* of the polishing pad 352. As illustrated in FIG. 2, the dressing unit 356 includes a dresser 50, a dresser shaft 51, an air cylinder 53, and a swing arm 55. The dresser 50 is brought into sliding contact with the polishing surface 352*a*. The dresser 50 is connected to the dresser shaft 51. The air cylinder 53 drives the dresser shaft 51 up and down. The swing arm 55 rotatably supports the dresser shaft 51. A dressing member 50*a* is held onto the lower portion of the dresser 50, and needle-shaped diamond particles are electrodeposited to the lower surface of the dressing member 50*a*. The air cylinder 53 is disposed on a support table 57 supported by support pillars 56, and the support pillars 56 are secured to the swing arm 55.

The swing arm 55 is configured to be driven by a motor (not illustrated) to turn about a spindle 58. The dresser shaft 51 is disposed to be opposed to the polishing pad 352 and rotated by the driving of a motor not illustrated in FIG. 2, and the dresser 50 is rotated about the dresser shaft 51 by the rotation of the dresser shaft 51. The air cylinder 53 moves the dresser 50 up and down via the dresser shaft 51, and presses the dresser 50 to the polishing surface 352*a* of the polishing pad 352 with a predetermined pressing force.

The dressing of the polishing surface 352*a* of the polishing pad 352 is performed as follows. The dresser 50 is pressed to the polishing surface 352*a* by the air cylinder 53, and the pure water is simultaneously supplied to the polishing surface 352*a* from a pure water supply nozzle (not illustrated). In this state, the dresser 50 rotates about the dresser shaft 51 to bring the lower surface (diamond particles) of the dressing member 50*a* into sliding contact with the polishing surface 352*a*. Thus, the polishing pad 352 is scraped off from the dresser 50, and the polishing surface 352*a* is dressed.

<Slip-Out Detector>

Figure 3:
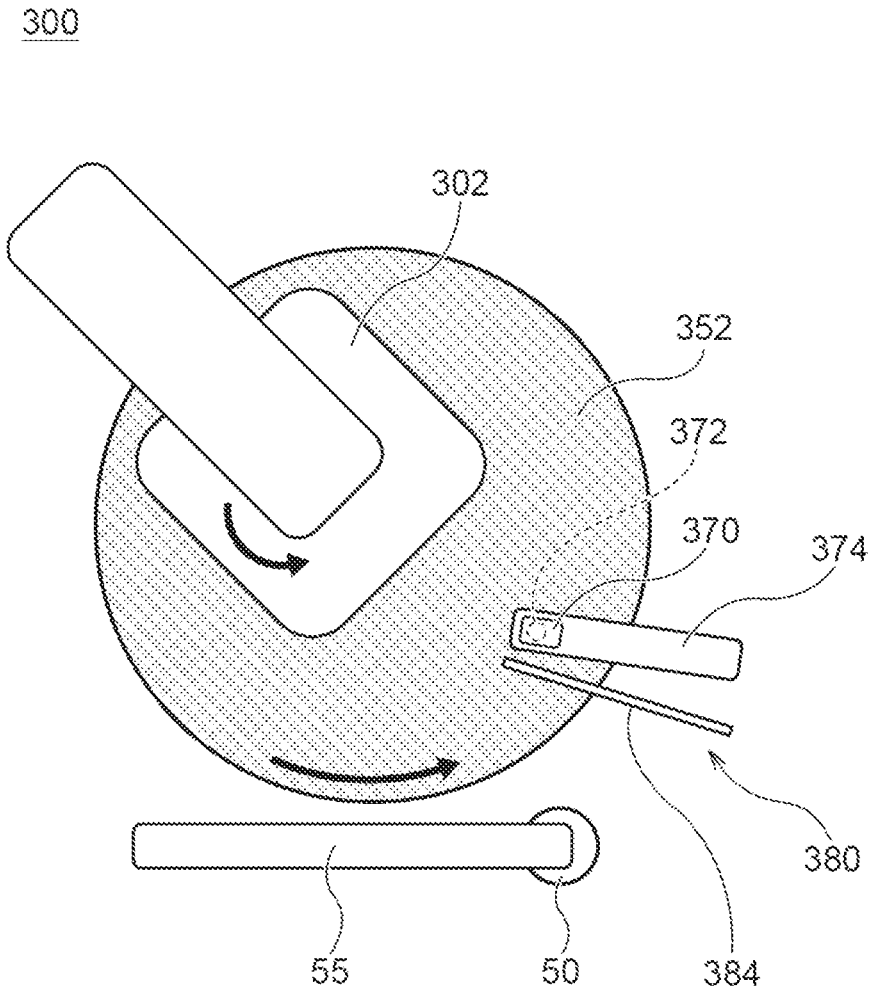
FIG. 3 is a plan view schematically illustrating the configuration of the polishing unit including a slip-out detector and an elimination mechanism.
Figure 4:
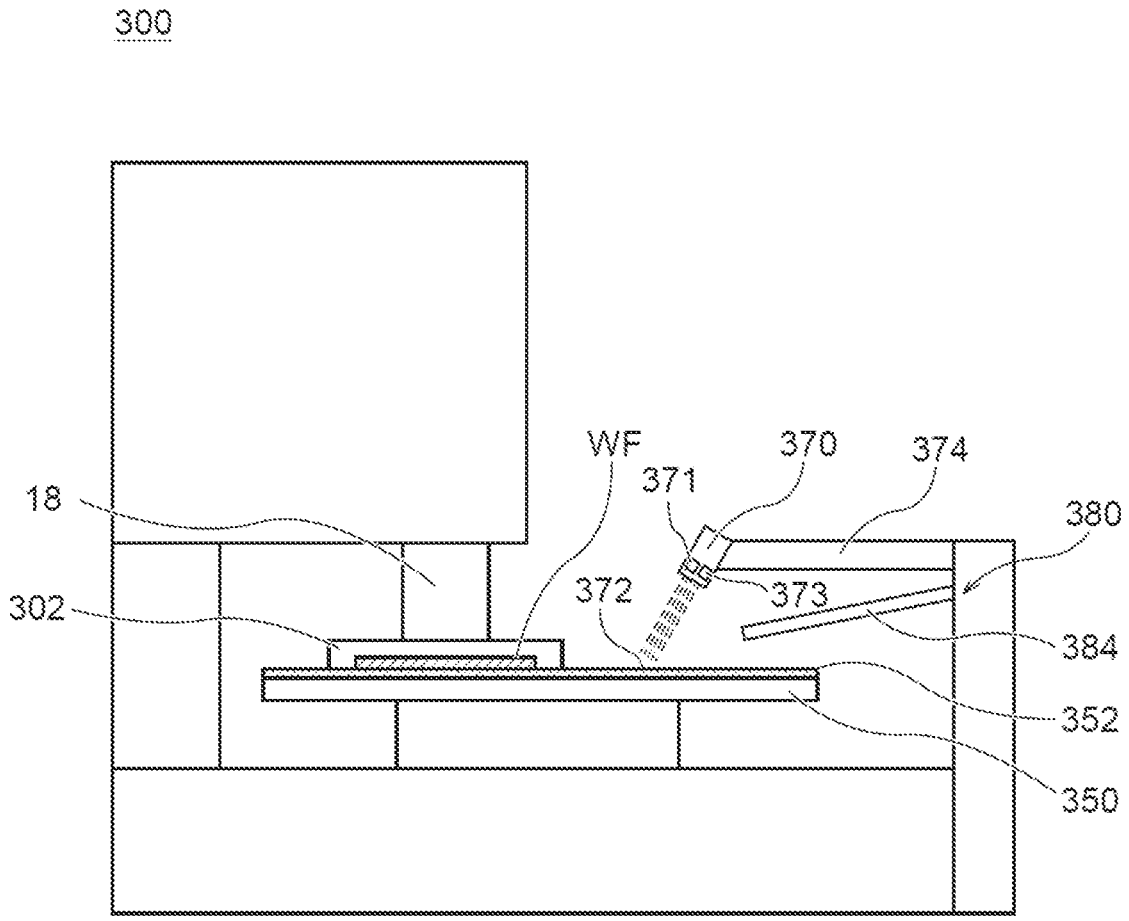
FIG. 4 is a side view schematically illustrating the configuration of the polishing unit including the slip-out detector and the elimination mechanism.

FIG. 3 is a plan view schematically illustrating the configuration of the polishing unit including a slip-out detector and an elimination mechanism. FIG. 4 is a side view schematically illustrating the configuration of the polishing unit including the slip-out detector and the elimination mechanism. As illustrated in FIG. 3 and FIG. 4, the polishing unit 300 includes a slip-out detector 370 to detect a slip out of the substrate WF from the top ring 302. At any position on the polishing pad 352, a detection area 372 for performing a slip-out detection is set. The slip-out detector 370 is mounted to a distal end of a slip-out detection arm 374 extending over the polishing pad 352, and disposed to be opposed to the detection area 372. The slip-out detector 370 includes a light source 371 to emit a light to the detection area 372 and a light detector 373 to receive a light reflected from the detection area 372. While this embodiment indicates an example in which the slip-out detector 370 includes the light source 371 and the slip-out detector 370 emits the light while simultaneously receiving the reflected light, the configuration is not limited to this. For example, the light source 371 may be a member independent from the slip-out detector 370. The slip-out detector 370 is configured to detect the slip out of the substrate WF from the top ring 302 based on the light received by the light detector 373, that is, the light reflected from the detection area 372.

More specifically, the slip-out detector 370 can detect the slip out of the substrate WF from the top ring 302 based on a change of a color of the light reflected from the detection area 372. That is, the slip-out detector 370 emits the light to the detection area 372 of the polishing pad 352 as a reference before the polishing process of the substrate WF is performed, and registers a reference color of the polishing pad based on the light reflected from the detection area 372. The slip-out detector 370 compares the color based on the light reflected from the detection area 372 of the polishing pad 352 with the reference color during the polishing process of the substrate WF.

Figure 5:
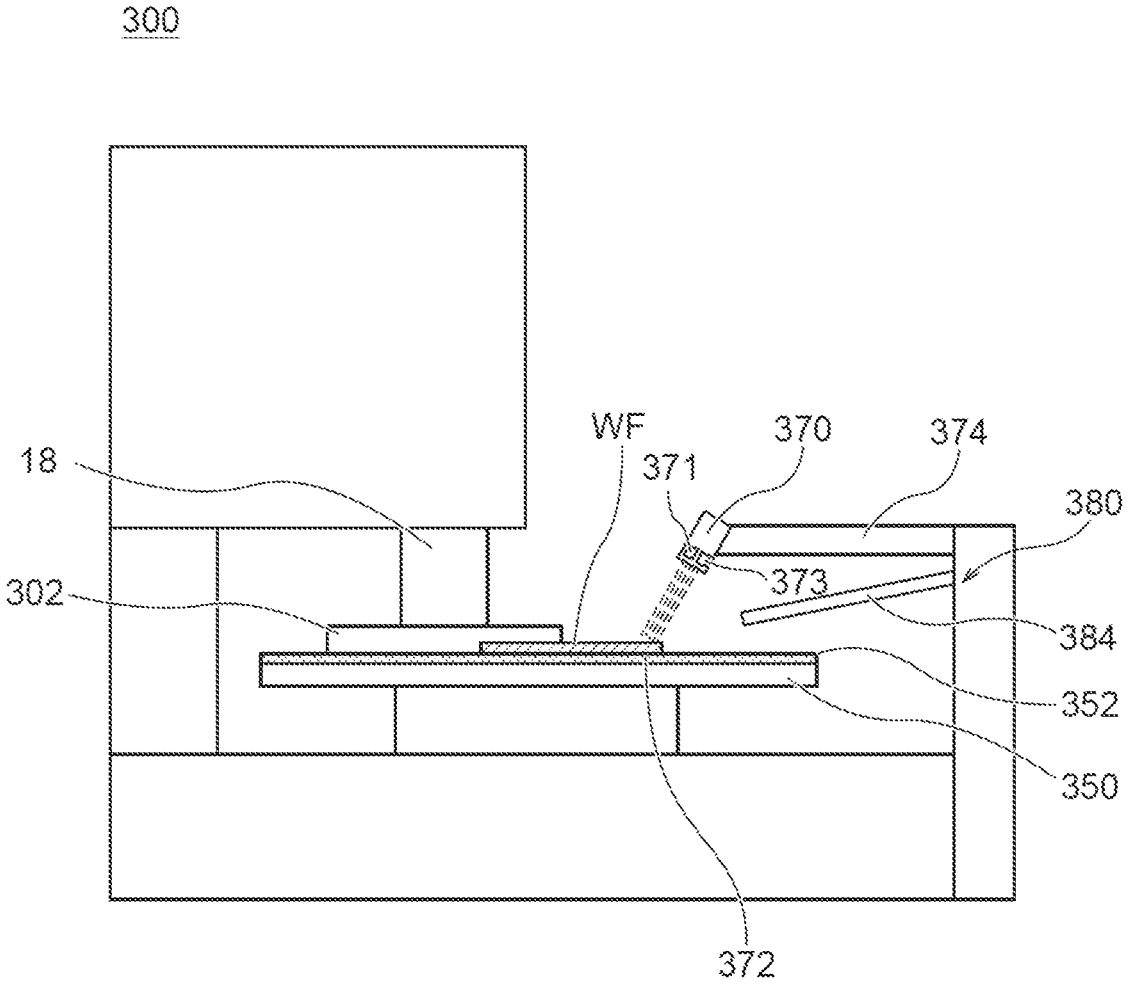
FIG. 5 is a side view schematically illustrating the configuration of the polishing unit including the slip-out detector and the elimination mechanism, and illustrates a state where a substrate has slipped out.

FIG. 5 is a side view schematically illustrating the configuration of the polishing unit including the slip-out detector and the elimination mechanism, and illustrates a state where the substrate WF has slipped out. As illustrated in FIG. 5, when the substrate WF comes off from the top ring 302 to enter the detection area 372, the slip-out detector 370 detects a color different from the reference color of the polishing pad 352, thereby ensuring the detection of the slip out of the substrate WF from the top ring 302.

Figure 6:
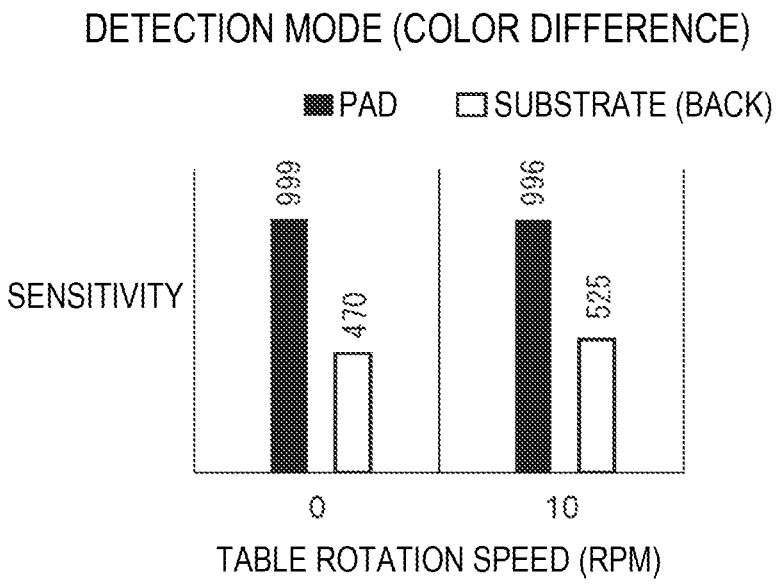
FIG. 6 is a drawing illustrating an experimental result of slip-out detection based on a color difference.

FIG. 6 is a drawing illustrating an experimental result of the slip-out detection based on a color difference. In FIG. 6, the horizontal axis indicates a rotation speed (RPM) of the polishing table 350, and the vertical axis indicates a sensitivity of color difference based on the reflected light from the detection area 372. The sensitivity of color difference based on the reflected light from the detection area 372 is a value that indicates a degree of match between the reference color registered in advance and the color based on the reflected light from the detection area 372. The value of the sensitivity when completely matching the reference color is 999. The slip-out detector 370 can detect the slip out of the substrate WF from the top ring 302 when the sensitivity of color difference based on the reflected light from the detection area 372 becomes less than a threshold value for the slip-out detection. For example, in FIG. 6, in the case where the rotation speed of the polishing table 350 is 10 (RPM), the sensitivity of color difference based on the reflected light from the detection area 372 is 996 when the polishing pad 352 is present (when the substrate WF has not entered) in the detection area 372, and the approximately matching with the reference color is seen. Meanwhile, when the substrate WF is present in the detection area 372, the sensitivity of color difference based on the reflected light from the detection area 372 is 525. For example, assume that the threshold value for the slip-out detection is 700. In this case, when the substrate WF comes off from the top ring 302 and enters the detection area 372, the sensitivity (525) of color difference based on the reflected light from the detection area 372 is less than the threshold value (700). Therefore, the slip-out detector 370 can detect the slip-out of the substrate WF.

Thus, when the sensitivity of color difference based on the reflected light from the detection area 372 is significantly different between the case where the polishing pad 352 is present (the substrate WF is absent) in the detection area 372 and the case where the substrate WF is present in the detection area 372, the slip-out detector 370 can accurately detect the slip out of the substrate WF from the top ring 302. As illustrated in the experimental result in FIG. 6, by using the color difference for the slip-out detection, the determination is made based on the difference between the color registered as the reference color and the color of the reflected light from the detection area 372. Therefore, the difference of reflection angle of the emitted/received light due to the difference of the thickness of the substrate WF and the light-amount difference of the reflected light due to the difference of the material of the substrate WF (including the influence of the difference in unevenness of the surface) are less likely to have influences, thus ensuring the effective slip-out detection of the substrate WF.

Meanwhile, when the colors of the polishing pad 352 and the substrate WF are close or when a disturbance has an influence, the difference of the sensitivity of color difference based on the reflected light from the detection area 372 possibly decreases between the case where the polishing pad 352 is present (the substrate WF is absent) in the detection area 372 and the case where the substrate WF is present in the detection area 372. In this case, the slip out of the substrate WF from the top ring 302 possibly cannot be detected regardless of the presence of the substrate WF in the detection area 372 depending on the setting of the threshold value for the slip-out detection.

In contrast to, the slip-out detector 370 can be configured to detect the slip out of the substrate WF from the top ring 302 based on the change of the amount of the light reflected from the detection area 372 in addition to the change of the color of the light reflected from the detection area 372. That is, the slip-out detector 370 emits the light to the detection area 372 of the polishing pad 352 as a reference before the polishing process of the substrate WF is performed, and registers a reference amount of the light reflected from the detection area 372. The slip-out detector 370 compares the amount of the light reflected from the detection area 372 of the polishing pad 352 with the preliminarily registered reference amount of the light during the polishing process of the substrate WF. When the substrate WF comes off from the top ring 302 and enters the detection area 372, the light amount different from the amount of the reflected light from the polishing pad 352 is detected. Therefore, the slip-out detector 370 can detect the slip out of the substrate WF from the top ring 302.

Figure 7:
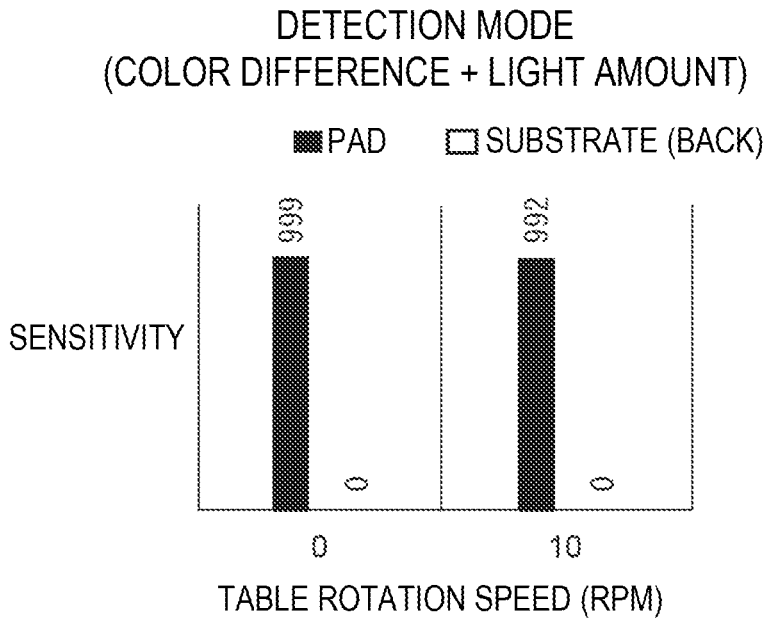
FIG. 7 is a drawing illustrating an experimental result of slip-out detection based on the color difference and a light amount.

FIG. 7 is a drawing illustrating an experimental result of the slip-out detection based on the color difference and the light amount. In FIG. 7, the horizontal axis indicates a rotation speed (RPM) of the polishing table 350, and the vertical axis indicates a sensitivity of color difference and light amount based on the reflected light from the detection area 372. The sensitivity of color difference and light amount based on the reflected light from the detection area 372 is a value that indicates a degree of match between the reference color and reference light amount registered in advance and the color and light amount based on the reflected light from the detection area 372. The slip-out detector 370 can detect the slip out of the substrate WF from the top ring 302 when the sensitivity of color difference and light amount based on the reflected light from the detection area 372 becomes less than a threshold value for the slip-out detection. As illustrated in FIG. 7, in the case of the slip-out detection based on the color difference and the light amount, the sensitivity of color difference and light amount based on the reflected light from the detection area 372 is significantly different between the case where the polishing pad 352 is present (the substrate WF is absent) in the detection area 372 and the case where the substrate WF is present in the detection area 372 regardless of the rotation speed of the polishing table 350. Accordingly, the slip-out detector 370 can accurately detect the slip out of the substrate WF from the top ring 302.

<Elimination Mechanism>

Figure 8:
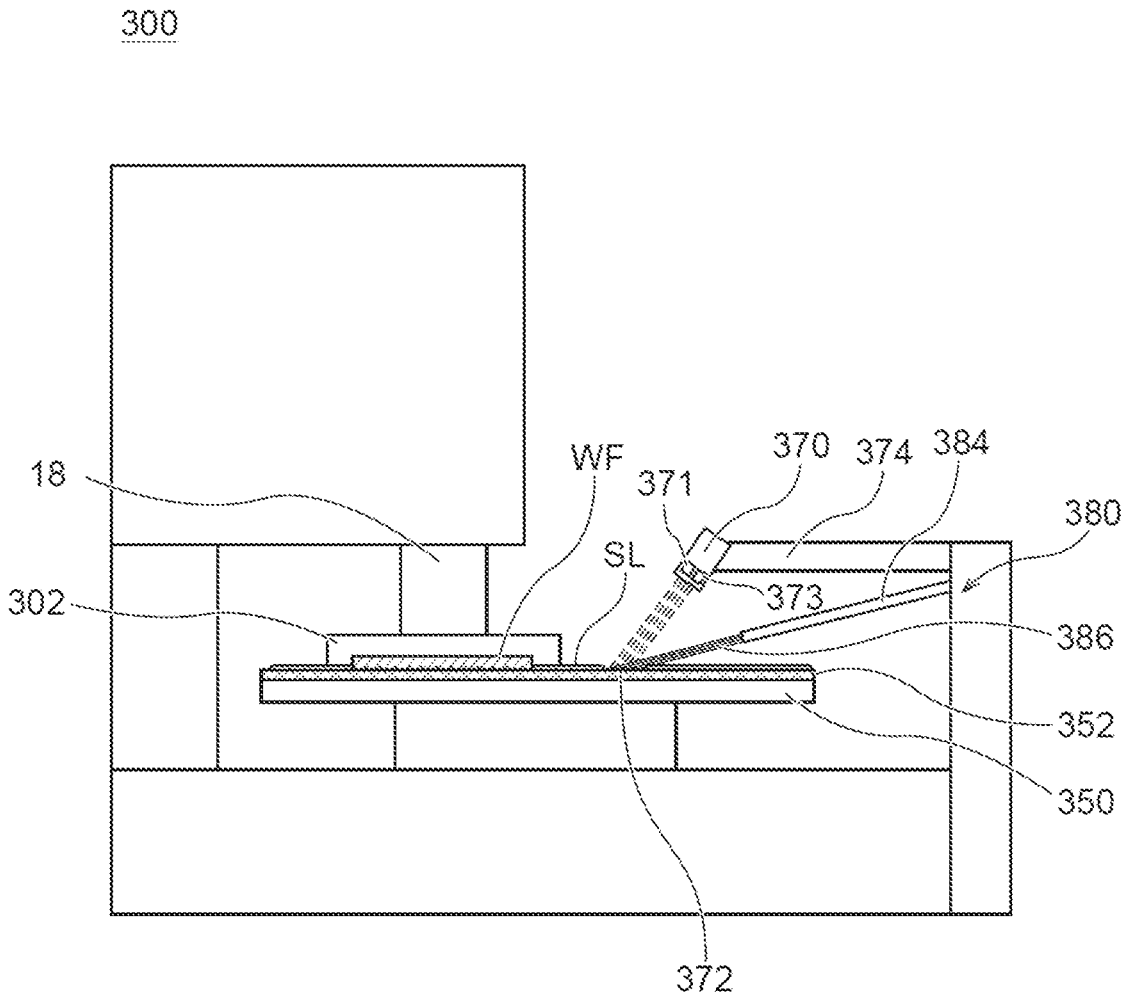
FIG. 8 is a side view schematically illustrating the configuration of the polishing unit including the slip-out detector and the elimination mechanism, and illustrates a state where the elimination mechanism is used to eliminate a polishing liquid.

As illustrated in FIG. 3, the polishing unit 300 includes an elimination mechanism 380 that eliminates the polishing liquid flowing into the detection area 372. FIG. 8 is a side view schematically illustrating the configuration of the polishing unit including the slip-out detector and the elimination mechanism, and illustrates a state where the elimination mechanism is used to eliminate the polishing liquid. As illustrated in FIG. 8, the elimination mechanism 380 includes a purge mechanism (purge nozzle) 384 that sprays a fluid 386 to the detection area 372 to eliminate a polishing liquid SL flowing into the detection area 372. The fluid may be a liquid, such as water or a polishing liquid having the same color as the polishing pad 352, or a gas, such as air or nitrogen.

Figure 9:
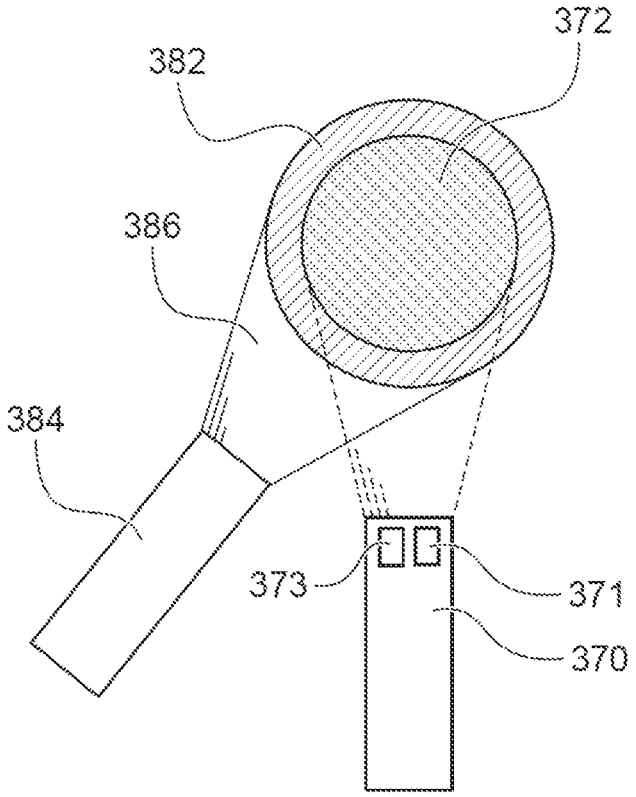
FIG. 9 is a plan view schematically illustrating a relation between a detection area and an elimination area on a polishing pad.

FIG. 9 is a plan view schematically illustrating the relation between the detection area and an elimination area on the polishing pad. As illustrated in FIG. 9, the purge mechanism 384 is configured to spray the fluid 386 from the purge mechanism 384 to an elimination area 382 as an area that includes the detection area 372 and is greater than the detection area 372. According to the embodiment, the accuracy of detecting the slip out of the substrate WF from the top ring 302 can be improved. That is, when the polishing liquid SL different in color from the polishing pad 352 is used, the slip-out detector 370 possibly makes a false detection when the polishing liquid SL flows into the detection area 372. Even when the polishing liquid SL having the same color as the polishing pad 352 is used, the slip-out detector 370 possibly makes a false detection when the polishing liquid SL including shavings of the substrate WF generated during the polishing or the polishing liquid SL discolored by a chemical reaction or the like flows into the detection area 372. In contrast, according to the embodiment, the purge mechanism 384 sprays the fluid 386 to the detection area 372 to avoid flowing of the polishing liquid SL into the detection area 372, thereby ensuring suppression of the occurrence of false detection by the slip-out detector 370. For aged deterioration of the polishing pad 352 and stains on the polishing pad 352 caused by the polishing process, a conditioning treatment of the polishing pad 352 may be performed by using at least one of the atomizer 358 and the dresser 50 for each substrate process. The slip-out detector 370 and the elimination mechanism 380 can be controlled to make the slip-out detection of the substrate WF effective only during the polishing of the substrate WF. For example, in a sequence of processes by the polishing unit 300, the dresser 50 moves across the detection area 372 for the conditioning treatment of the polishing pad 352 in some cases. In this case, operation timings of the slip-out detector 370 and the elimination mechanism 380 can be controlled to avoid the false detection by the slip-out detector 370.

Figure 10:
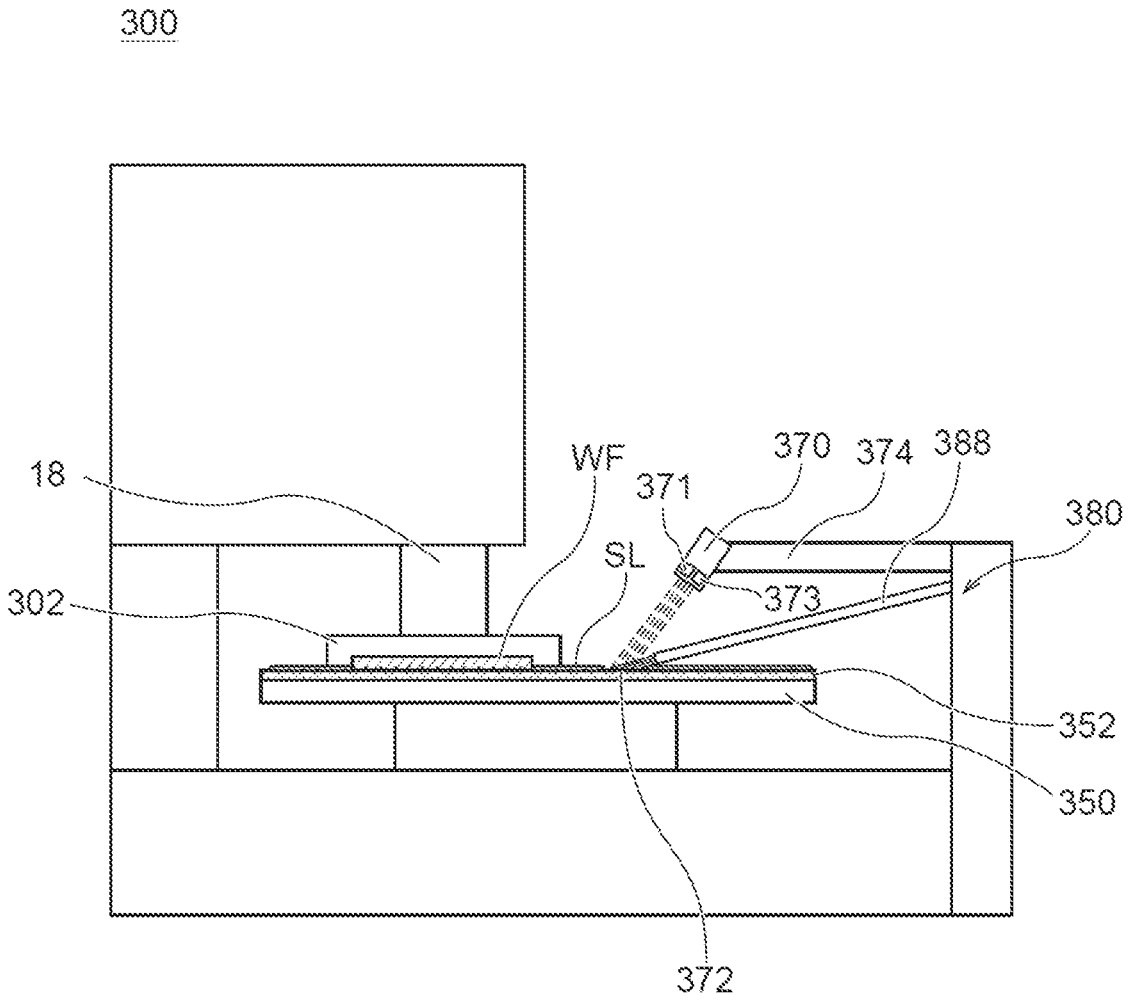
FIG. 10 is a side view schematically illustrating the configuration of the polishing unit including the slip-out detector and the elimination mechanism, and illustrates a state where the elimination mechanism is used to eliminate the polishing liquid.

While the example in which the elimination mechanism 380 includes the purge mechanism 384 is indicate in this embodiment, the configuration is not limited to this. FIG. 10 is a side view schematically illustrating the configuration of the polishing unit including the slip-out detector and the elimination mechanism, and illustrates a state where the elimination mechanism is used to eliminate the polishing liquid. The elimination mechanism 380 may include a suction mechanism (suction nozzle) 388 that suctions the polishing liquid SL flow into the detection area 372 to eliminate the polishing liquid SL flowing into the detection area 372. In this case, the suction mechanism 388 can eliminate the polishing liquid SL flowing into the detection area 372 by performing the suction to the elimination area 382.

Figure 11:
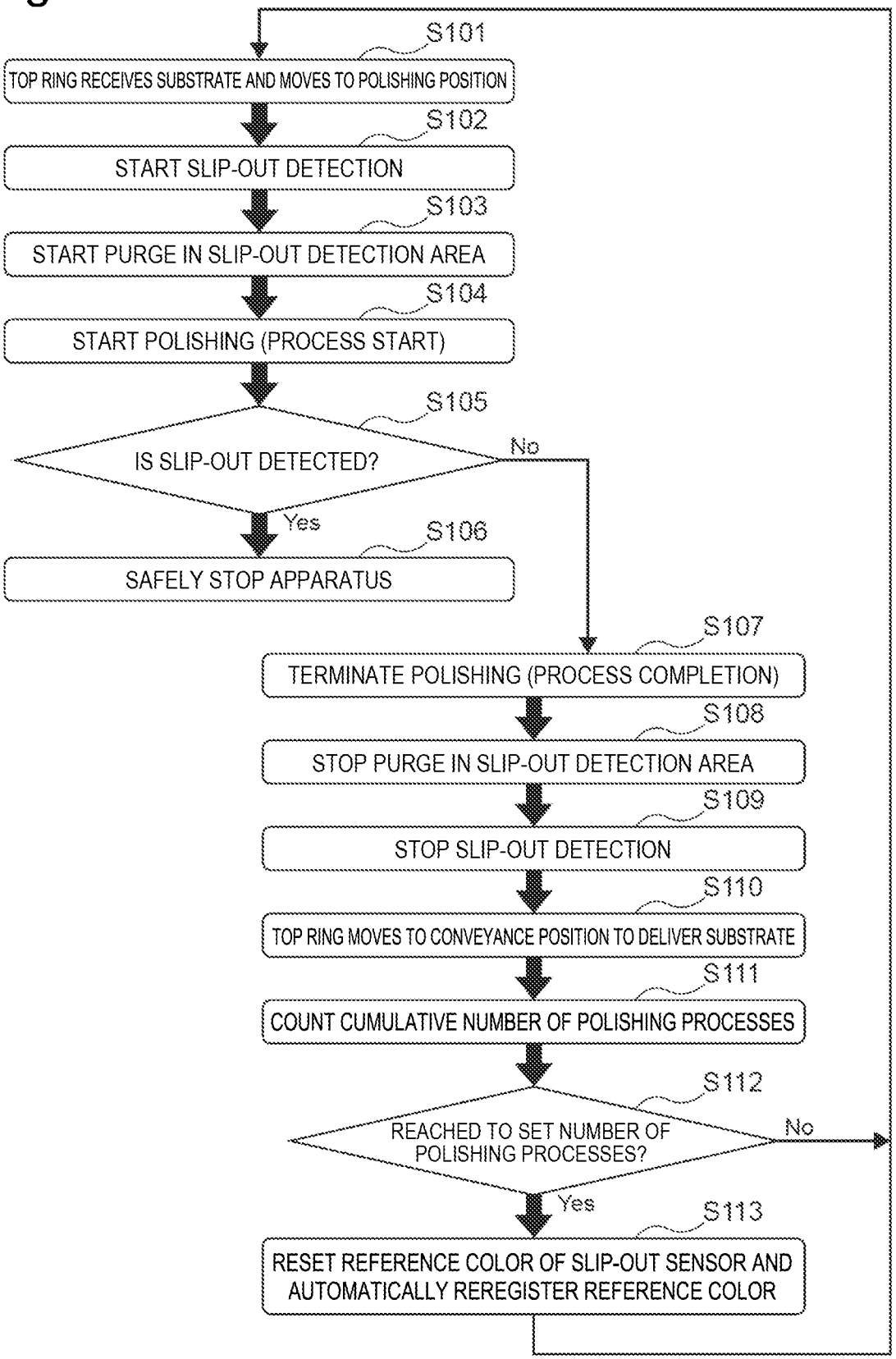
FIG. 11 is a flowchart of the slip-out detection of the substrate.

Next, a description will be given of a procedure of a polishing method including the slip-out detection of the substrate WF according to the embodiment. FIG. 11 is a flowchart of the slip-out detection of the substrate WF. As illustrated in FIG. 11, in the polishing method, first, the top ring 302 receives the substrate WF and moves to a polishing position (Step S101). Subsequently, the polishing method starts the slip-out detection (detecting step S102). Specifically, the polishing method starts emitting and receiving the light by the slip-out detector 370. Subsequently, the polishing method starts the purge in a slip-out detection area (elimination step S103). Specifically, the polishing method sprays the fluid from the purge mechanism (purge nozzle) 384 to the elimination area 382.

Subsequently, the polishing method starts the polishing of the substrate WF (polishing step S104). That is, the polishing method rotates the polishing table 350 while rotating the top ring 302, and presses the substrate WF held onto the top ring 302 to the polishing pad 352. Subsequently, the polishing method determines whether the slip-out of the substrate WF is detected or not (Step S105). When the slip-out of the substrate WF is detected by the slip-out detector 370 (Step S105, Yes), the polishing method safely stops the operation of the substrate processing apparatus 1000 (Step S106).

Meanwhile, when the slip-out of the substrate WF is not detected by the slip-out detector 370 (Step S105, No), and a predetermined polishing time has passed, the polishing method terminates the polishing of the substrate WF (Step S107). Subsequently, the polishing method stops the purge in the slip-out detection area (Step S108). Subsequently, the polishing method stops the emitting and receiving of the light by the slip-out detector 370 to stop the slip-out detection (Step S109). Subsequently, in the polishing method, the top ring 302 delivers the substrate WF to the conveyance unit 200 (Step S110).

Subsequently, the polishing method counts a cumulative number of polishing processes in the polishing unit 300 (Step S111). Subsequently, the polishing method determines whether the counted cumulative number of polishing processes has reached a preliminarily set number of polishing processes (threshold value) or not (Step S112). When the counted cumulative number of polishing processes does not exceed the preliminarily set number of polishing processes (threshold value) (Step S112, No), the polishing method returns to Step S101 and repeats the process to the substrate WF as a next process target. Meanwhile, when the counted cumulative number of polishing processes exceeds the preliminarily set number of polishing processes (threshold value) (Step S112, Yes), the polishing method resets the reference color of the slip-out detector 370 and automatically reregisters the reference color (Step S113). That is, the slip-out detector 370 assumes the current polishing pad 352 as the reference polishing pad, emits the light to the detection area 372 of this polishing pad 352, and registers the reference color of the polishing pad based on the light reflected from the detection area 372. The polishing method returns to Step S101 after Step S113, and repeats the process to the substrate WF as the next process target. Note that the order of the above-described processing steps may be changed, or they may be simultaneously executed.

Figure 12:
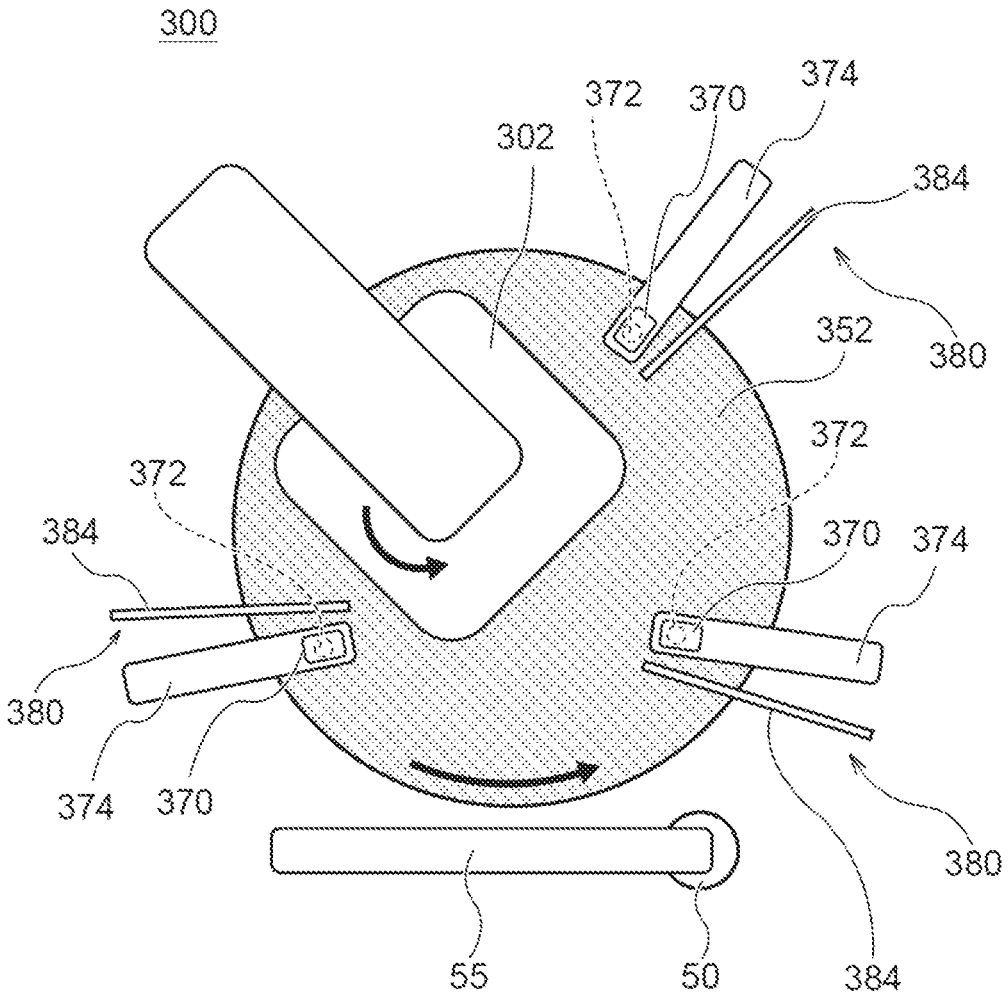
FIG. 12 is a plan view schematically illustrating a configuration of a modification of the polishing unit including the slip-out detector and the elimination mechanism.

FIG. 12 is a plan view schematically illustrating a configuration of a modification of the polishing unit including the slip-out detector and the elimination mechanism. As illustrated in FIG. 12, a plurality of the detection areas 372 may be set on the polishing pad 352. In this case, a plurality of the slip-out detectors 370 and a plurality of the elimination mechanisms 380 may be disposed corresponding to the respective plurality of detection areas 372 on the polishing pad 352. According to this embodiment, the slip out of the substrate WF can be detected with high accuracy even when the substrate WF projects from the top ring 302 in various directions.

Figure 13:
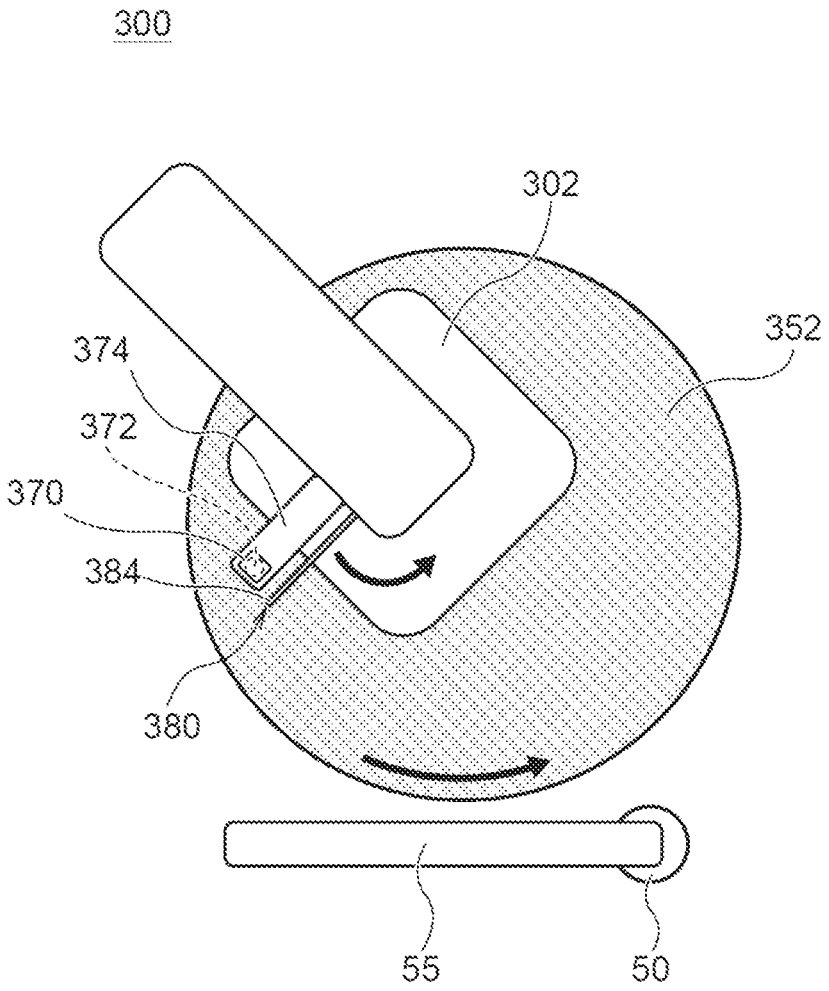
FIG. 13 is a plan view schematically illustrating a configuration of a modification of the polishing unit including the slip-out detector and the elimination mechanism.

FIG. 13 is a plan view schematically illustrating a configuration of a modification of the polishing unit including the slip-out detector and the elimination mechanism. As illustrated in FIG. 13, the slip-out detector 370 and the elimination mechanism 380 may be mounted to the top ring 302. That is, while the detection area 372 can be set to any position on the polishing pad 352, the detection area 372 is preferably set to the proximity of the top ring 302 in the downstream side in the rotation direction of the polishing pad 352. This is because, since the substrate WF projects from the top ring 302 often to the downstream side in the rotation direction of the polishing pad 352 when the substrate WF comes off from the top ring 302, the slip out of the substrate WF from the top ring 302 can be instantly detected. However, when the top ring 302 is swung on the polishing pad 352 by the swing arm 360 during the polishing, the position of the detection area 372 also moves. Therefore, a mechanism that moves the slip-out detector 370 and the elimination mechanism 380 corresponding to the move of the detection area 372 is required, thus complicating the configuration of the polishing unit 300. In contrast, according to the embodiment, since the slip-out detector 370 and the elimination mechanism 380 are mounted to the top ring 302, the slip-out detector 370 and the elimination mechanism 380 swing in accordance with the swing of the top ring 302. Accordingly, this embodiment ensures instantly detecting the slip out of the substrate WF from the top ring 302 with the simple structure.

The embodiments of the present invention have been described above in order to facilitate understanding of the present invention without limiting the present invention. The present invention can be changed or improved without departing from the gist thereof, and of course, the equivalents of the present invention are included in the present invention. It is possible to arbitrarily combine or omit respective components according to claims and description in a range in which at least a part of the above-described problems can be solved, or a range in which at least a part of the effects can be exhibited.

This application discloses, as one embodiment, a polishing unit that includes a polishing table, a top ring, a light emitting member, a slip-out detector, and an elimination mechanism. A polishing pad for polishing a substrate is attached to the polishing table. The top ring holds the substrate to press the substrate against the polishing pad. The light emitting member emits a light to a detection area on the polishing pad. The slip-out detector detects a slip out of the substrate from the top ring based on the light reflected from the detection area. The elimination mechanism eliminates a polishing liquid flowing into the detection area.

This application further discloses, as one embodiment, the polishing unit in which the slip-out detector detects the slip out of the substrate from the top ring based on a change of a color of the light reflected from the detection area.

This application further discloses, as one embodiment, the polishing unit in which the slip-out detector detects the slip out of the substrate from the top ring based on a change of an amount of the light reflected from the detection area in addition to the change of the color of the light reflected from the detection area.

This application further discloses, as one embodiment, the polishing unit in which the elimination mechanism includes a purge mechanism for spraying a fluid to the detection area to eliminate the polishing liquid flowing into the detection area.

This application further discloses, as one embodiment, the polishing unit in which the elimination mechanism includes a suction mechanism for suctioning the polishing liquid flowing into the detection area to eliminate the polishing liquid flowing into the detection area.

This application further discloses, as one embodiment, the polishing unit in which the light emitting member, the slip-out detector, and the elimination mechanism are disposed to each of a plurality of detection areas on the polishing pad.

This application further discloses, as one embodiment, the polishing unit in which the light emitting member, the slip-out detector, and the elimination mechanism are mounted to the top ring.

This application further discloses, as one embodiment, a substrate processing apparatus that includes any one of the above-described polishing units that polishes a substrate, a conveyance unit that conveys the substrate, and a drying unit that dries the substrate.

This application further discloses, as one embodiment, a polishing method that includes a polishing step of polishing a substrate by flowing a polishing liquid on a polishing pad that polishes the substrate, a detecting step of emitting a light to a detection area on the polishing pad and detecting a slip out of the substrate from the top ring based on the light reflected from the detection area, and an eliminating step of eliminating the polishing liquid flowing into the detection area.

This application further discloses, as one embodiment, the polishing method in which the detecting step includes detecting the slip out of the substrate from the top ring based on a difference between a reference color of a light reflected from the detection area of the polishing pad as a reference and a color of the light reflected from the detection area of the polishing pad during a polishing process.

This application further discloses, as one embodiment, the polishing method that further includes a step of counting a cumulative number of polishing processes of the substrate and a step of registering the reference color when the cumulative number of polishing processes exceeds a threshold value.

REFERENCE SIGNS LIST

200 . . . conveyance unit
300 . . . polishing unit
302 . . . top ring
350 . . . polishing table
352 . . . polishing pad
370 . . . slip-out detector
371 . . . light source
372 . . . detection area
373 . . . light detector
374 . . . slip-out detection arm
380 . . . elimination mechanism
382 . . . elimination area
384 . . . purge mechanism (purge nozzle)
386 . . . fluid
388 . . . suction mechanism (suction nozzle)
500 . . . drying unit
1000 . . . substrate processing apparatus
SL . . . polishing liquid
WF . . . substrate

What is claimed is:

1. A polishing unit comprising:

a rotatable polishing table to which a polishing pad for polishing a substrate is attached;

a top ring configured to hold the substrate to press the substrate against the polishing pad;

a slip-out detector comprising:

a light source configured to emit a light to a detection area on the polishing pad; and a light detector configured to detect the light reflected from the detection area;

the slip-out detector configured to detect a slip out of the substrate from the top ring based on the light reflected from the detection area; and an elimination mechanism configured to eliminate a polishing liquid flowing into the detection area, the elimination mechanism located at an upstream side of the light detector in a direction of rotation of the polishing table, wherein the slip-out detector is configured to detect the slip out of the substrate from the top ring based on a difference between a reference color and a color of light reflected from the detection area of the polishing pad during a polishing process, wherein the polishing unit is configured to count a cumulative number of polishing processes of the substrate, wherein the polishing unit is configured to reset the reference color of the slip-out detector and automatically register the reference color based on the light reflected from the detection area when the counted cumulative number of polishing processes exceeds a threshold value, and wherein the slip-out detector is configured to detect the slip out of the substrate from the top ring based on a difference between the registered reference color and the color of light reflected from the detection area of the polishing pad during the polishing process.

2. The polishing unit according to claim 1, wherein the slip-out detector is configured to detect the slip out of the substrate from the top ring based on a change of an amount of the light reflected from the detection area in addition to the difference between the reference color or the registered reference color and the color of the light reflected from the detection area of the polishing pad during the polishing process.

3. The polishing unit according to claim 1, wherein the elimination mechanism includes a purge mechanism for spraying a fluid to the detection area to eliminate the polishing liquid flowing into the detection area.

4. The polishing unit according to claim 1, wherein the elimination mechanism includes a suction mechanism for suctioning the polishing liquid flowing into the detection area to eliminate the polishing liquid flowing into the detection area.

5. The polishing unit according to claim 1, wherein the light source, the light detector, and the elimination mechanism are disposed to each of a plurality of detection areas on the polishing pad.

6. The polishing unit according to claim 1, wherein the light source, the light detector, and the elimination mechanism are mounted to the top ring.

7. A substrate processing apparatus comprising:

the polishing unit for polishing the substrate according to claim 1;

a conveyance unit for conveying the substrate; and a drying unit for drying the substrate.

8. A polishing method comprising:

rotating a polishing table to which a polishing pad is attached;

polishing a substrate by flowing a polishing liquid on the polishing pad that polishes the substrate held by a top ring;

detecting a slip out of the substrate from the top ring by emitting a light to a detection area on the polishing pad and receiving the light reflected from the detection area; and eliminating the polishing liquid flowing into the detection area from an upstream side of the detection area in a direction of rotation of the polishing table, wherein detecting the slip out of the substrate includes detecting the slip out of the substrate from the top ring based on a difference between a reference color and a color of the light reflected from the detection area of the polishing pad during a polishing process, wherein detecting the slip out of the substrate further includes:

counting a cumulative number of polishing processes of the substrate;

resetting the reference color by automatically registering the reference color based on the light reflected from the detection area of the polishing pad when the counted cumulative number of polishing processes exceeds a threshold value; and detecting the slip out of the substrate from the top ring based on a difference between the registered reference color and the color of the light reflected from the detection area of the polishing pad during the polishing process.

* * * * *